US008720213B2

(12) United States Patent
Cochran et al.

(10) Patent No.: US 8,720,213 B2
(45) Date of Patent: May 13, 2014

(54) VARIABLE DISPLACEMENT COMPRESSOR WITH A COMPENSATED SUCTION SHUFOFF VALVE

(75) Inventors: Theodore R. Cochran, Amherst, NY (US); Joseph M. Bona, Williamsville, NY (US); Gregory M. Dennis, Willaimsville, NY (US); Matthew R. Warren, Buffalo, NY (US)

(73) Assignee: Delphi Technologies, Inc., Troy, MI (US)

( * ) Notice: Subject to any disclaimer, the term of this patent is extended or adjusted under 35 U.S.C. 154(b) by 316 days.

(21) Appl. No.: 12/372,131

(22) Filed: Feb. 17, 2009

(65) Prior Publication Data

US 2009/0205347 A1 Aug. 20, 2009

Related U.S. Application Data

(60) Provisional application No. 61/066,213, filed on Feb. 19, 2008.

(51) Int. Cl.
*F25B 41/04* (2006.01)
*F25B 49/00* (2006.01)

(52) U.S. Cl.
USPC ..... 62/217; 62/228.3; 62/228.5

(58) Field of Classification Search
USPC ..... 62/217, 228.1, 228.3, 228.5, 296; 417/212, 213
See application file for complete search history.

(56) References Cited

U.S. PATENT DOCUMENTS

| | | | | | |
|---|---|---|---|---|---|
| 4,709,555 | A | * | 12/1987 | Kawai et al. | 62/228.3 |
| 4,905,477 | A | * | 3/1990 | Kazuhiko | 62/196.3 |
| 5,823,000 | A | * | 10/1998 | Takai | 62/133 |
| 6,105,380 | A | * | 8/2000 | Yokomachi et al. | 62/228.3 |
| 6,148,632 | A | * | 11/2000 | Kishita et al. | 62/323.1 |
| 6,263,687 | B1 | * | 7/2001 | Ban et al. | 62/228.3 |

* cited by examiner

*Primary Examiner* — Marc Norman
(74) *Attorney, Agent, or Firm* — Lawrence D. Hazelton

(57) ABSTRACT

A variable displacement compressor with a compensated suction shutoff valve (SSV). The SSV prevents noise generated by a suction reed valve at low refrigerant flow rates in an internal suction region from propagating to an air conditioner evaporator by moving a piston to obstruct an opening and restrict fluid communication. The degree of restriction is decreased by an opening force generated by refrigerant at an external suction pressure acting over a first area, and increased by refrigerant at a crankcase pressure acting over a second area. The second area is smaller than the first area so that at high refrigerant flow rates, the effect of crankcase pressure is reduced so that the restriction is reduced and the compressor operates at greater efficiency. The piston position is also influenced by refrigerant at a pressure intermediate the external suction pressure and the internal suction pressure acting over a third area.

7 Claims, 6 Drawing Sheets

VARIABLE DISPLACEMENT COMPRESSOR WITH A COMPENSATED SUCTION SHUFOFF VALVE

This application claims the benefit of U.S. Provisional Application No. 61/066,213 filed Feb. 19, 2008.

TECHNICAL FIELD OF INVENTION

The invention relates to a variable displacement compressor having a suction shutoff valve (SSV) that impedes noise generated by the compressor from reaching the evaporator. More particularly, the SSV provides a variable restriction that is compensated by the pressure of the refrigerant in the crankcase.

BACKGROUND OF INVENTION

Automobiles have air conditioners for reducing the temperature of air in an automobile passenger compartment. The air conditioner operates by compressing refrigerant using a compressor, reducing the temperature of the compressed refrigerant, and then expanding (uncompressing) the refrigerant to reduce the refrigerant temperature. The expanded refrigerant then flows through an evaporator used to lower the temperature of the air in the passenger compartment. Variable displacement compressors vary compressor displacement to vary the flow rate of refrigerant through the compressor. After the compressor establishes a sufficient pressure difference in the air conditioner, it may be advantageous to reduce the displacement or capacity of the compressor and operate at low refrigerant flow rates. Under low flow conditions, suction reed flutter in the compressor can create pressure pulsations that propagate into the air conditioner evaporator. These pressure pulsations may be heard inside the vehicle passenger compartment.

It is known to include a suction shutoff valve (SSV) in a compressor to restrict communication of the suction reed flutter noise to the evaporator. However, a SSV providing adequate restriction at low flow conditions has undesirable flow restriction and pressure loss at high flow rates. At high flow rates it is advantageous to minimize the restriction of refrigerant flow to the compressor so the compressor can operate at maximum efficiency. What is needed is a SSV that has adequate restriction at low refrigerant flow rates and lower restriction at high refrigerant flow rates.

SUMMARY OF THE INVENTION

The subject invention provides a variable displacement compressor for compressing refrigerant drawn from a suction region in fluid communication with an evaporator, and discharging refrigerant into a discharge region at a discharge flow rate. The compressor has a suction reed valve for preventing refrigerant drawn into the compressor from returning to the suction region, which is subject to fluttering and generating a noise when the discharge flow rate is low. The compressor also includes a suction shutoff valve (SSV) segregating the suction region into an external suction region and an internal suction region, which variably restricts fluid communication between the external and internal suction regions for preventing noise from the suction reed valve from propagating to the evaporator. The SSV has a movable piston configured to cover an opening in the SSV that provides the fluid communication between the external suction region and the internal suction region and thereby restrict fluid communication. The piston has a first face exposed to refrigerant from the external suction region and defining a first face area, and a second face rigidly coupled to and axially opposed to the first face, exposed to refrigerant from the crankcase region, and defining a second face area, whereby an opening force generated by the external suction pressure acting upon the first face area, which urges the SSV to decrease the restriction is opposed by a closing force generated by the crankcase pressure acting upon the second face area, which urges the SSV to increase the restriction. The second face area is smaller than the first face area. This feature reduces the closing force relative to the opening force, thereby reducing the restriction of the SSV at high refrigerant flow rates.

Further features and advantages of the invention will appear more clearly on a reading of the following detail description of the preferred embodiment of the invention, which is given by way of non-limiting example only and with reference to the accompanying drawings.

BRIEF DESCRIPTION OF DRAWINGS

This invention will be further described with reference to the accompanying drawings in which.

DETAILED DESCRIPTION OF INVENTION

Figure 1:
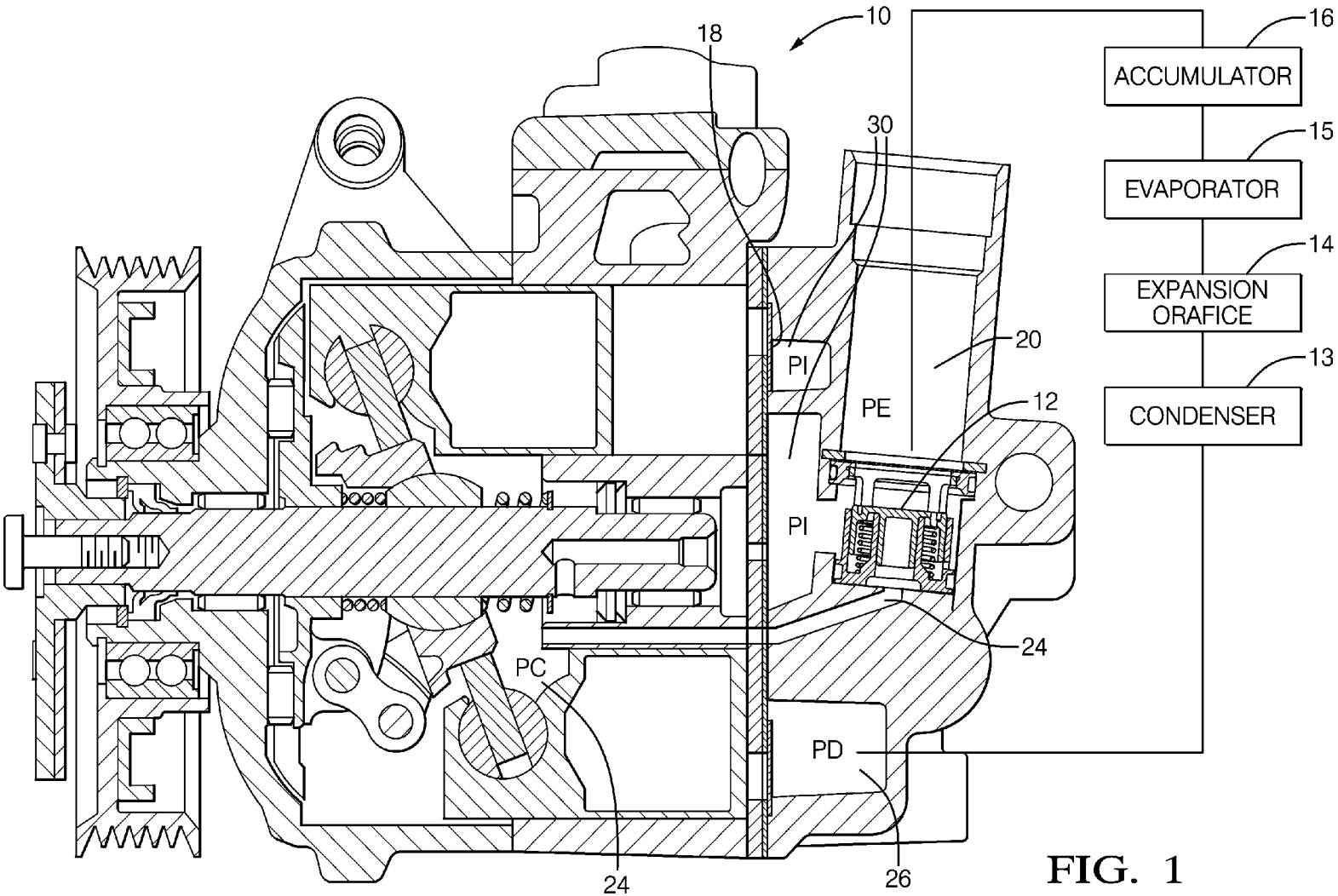
FIG. 1 is a cross sectional view of a variable displacement compressor having a suction shutoff valve (SSV)

In accordance with a preferred embodiment of this invention, FIG. 1 shows a variable displacement compressor 10 suitable for use in a vehicle air conditioner. The air conditioner cools air circulating into a vehicle passenger compartment when a difference in refrigerant pressure is present. Refrigerant compressed by the compressor is discharged at a discharge flow rate into a discharge region 26 containing refrigerant at a discharge pressure PD. The compressed refrigerant then flows to a condenser 13. From condenser 13, refrigerant then flows through an expansion orifice 14 to reduce the pressure of the refrigerant, thereby reducing the temperature of the refrigerant below the ambient temperature, and into an evaporator 15 as a cool vapor. Warmed refrigerant gas exiting the evaporator 15 returns to the compressor 10 and is drawn into a suction region of the compressor 10.

Compressor 10 is a variable displacement type compressor which provides a variable refrigerant discharge flow rate. The compressor 10 has a crankcase region 24 containing refrigerant at a crankcase pressure PC. The crankcase region 24 is in regulated fluid communication with an internal suction region 22 that is part of the suction region, and the discharge region 26. The refrigerant pressure difference between the internal suction region 22 and the crankcase region 24 is used by the compressor 10 to influence the displacement of the compressor. When the air conditioner is initially activated after an extended period of inactivity, more than one hour for example, refrigerant pressure throughout the air conditioner is substantially equal, so the pressure difference between the suction region and the crankcase region is about zero. To quickly establish the difference in pressure necessary for the air conditioner to cool air, the initial zero pressure difference causes the variable displacement to be high, thus the discharge flow rate is high. After a pressure difference is established, the displacement is reduced in response to the increasing pressure difference, thereby reducing the discharge flow rate and reducing the energy requirements of the compressor. High air conditioner demand, which may occur when the ambient air temperature is high, may also result in a low pressure difference and a high discharge flow rate. For more a more detailed description of variable displacement compressors, see U.S. Pat. No. 4,428,718 to Skinner, which is hereby incorporated by reference.

Compressor 10 includes a suction reed valve 18 for preventing refrigerant drawn into the compressor from returning to the suction region. When the discharge flow rate is low, less than 75 pounds per hour for example, the suction reed valve is capable of generating a noise that may propagate to the evaporator 15 and be heard by occupants in the vehicle passenger compartment. This phenomenon of suction reed valve noise is further described in U.S. Pat. No. 6,257,848 to Terauchi, which is hereby incorporated by reference.

Compressor 10 has a suction shutoff valve (SSV) 12 for impeding the noise generated by the suction reed valve 18 from communicating with or propagating to the evaporator 15. The SSV 12 segregates the refrigerant path between the evaporator 15 and the suction reed valve 18 into an external suction region 20 containing refrigerant at an external suction pressure PE, and an internal suction region 22 containing refrigerant at an internal suction pressure PI. During compressor operation, refrigerant flows from the evaporator 15 into the external suction region 20, then through the SSV 12 into the internal suction region 22, and then through the suction reed valve 18. The SSV 12 impedes the suction reed valve noise by obstructing or restricting the fluid communication between the external suction region 20 and the internal suction region 22. The SSV is also in fluid communication with the crankcase region 24 containing refrigerant at a crankcase pressure PC and the degree of restriction is influenced by PC, PI, and PE. The compressor displacement and therefore the discharge flow rate are influenced by the difference between PC and PI (PC-PI). When the difference PC-PI is low, less than 6 pounds per square inch (p.s.i.) for example, and the refrigerant flow rate is consequently high, greater than 100 pounds per hour, it is advantageous for the SSV restriction to be low so the SSV has minimal effect on the efficiency of the compressor. When the difference between PC-PI is high, greater than 6 p.s.i. for example, and the refrigerant flow rate is consequently low, less than 75 pounds per hour, it is advantageous for the SSV restriction to be high so the SSV impedes noise generated by the suction reed valve from propagating to the evaporator.

Figure 2:
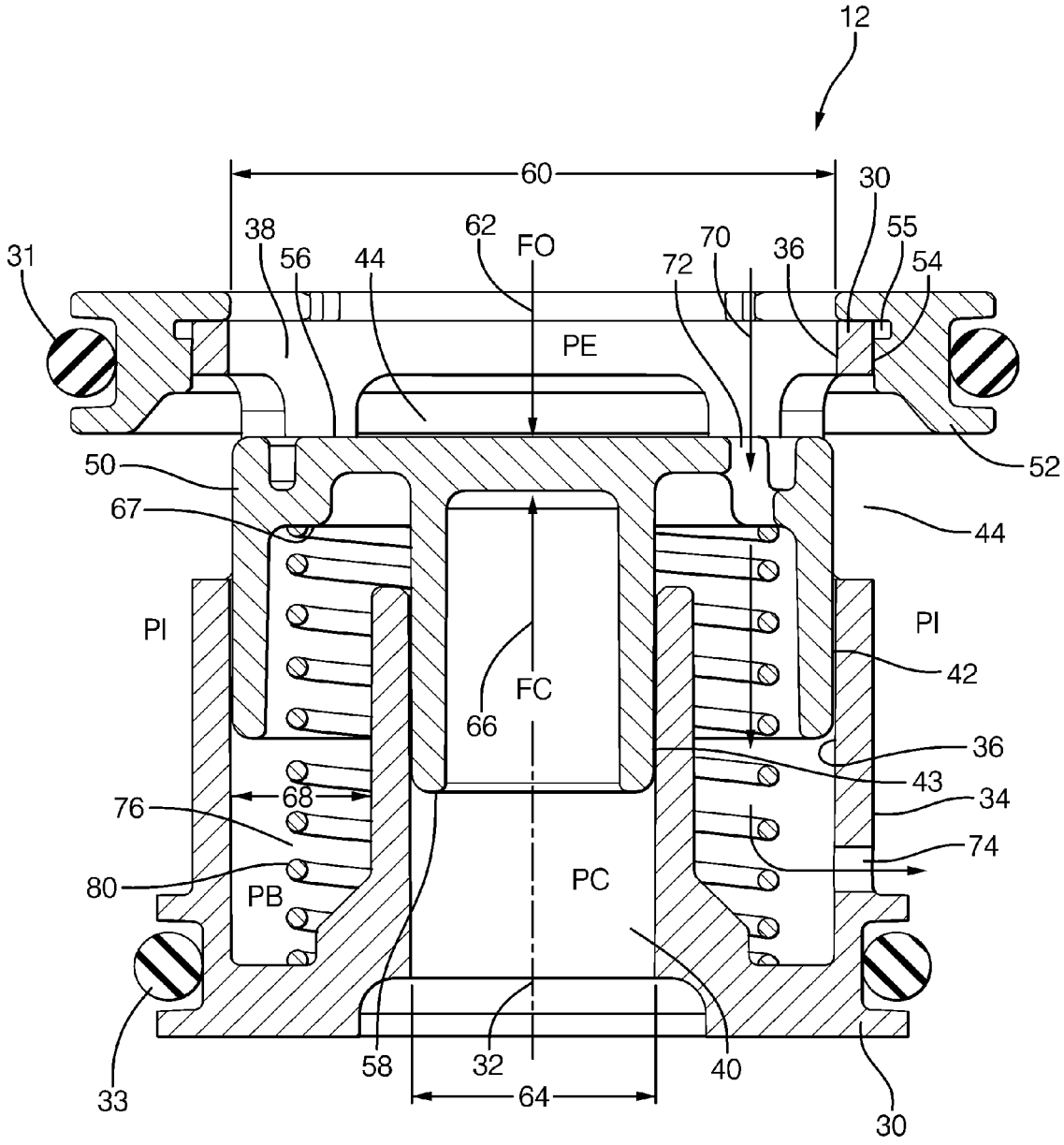
FIG. 2 is a cross sectional view of the SSV in FIG. 1.

Referring now to FIG. 2, the SSV has a housing 30 that is generally cylindrical in shape defining a longitudinal axis 32 through the center of the cylindrical shape. The housing 30 has an outer surface 34 exposed to refrigerant in the internal suction region 22, and an inner surface 36. The inner surface has a first end portion 38 exposed to refrigerant in the external suction region 20 at the suction pressure PE, a second end portion 40 exposed to refrigerant from the crankcase region 24 at the crankcase pressure PC. An O-ring 31 and an O-ring 33 seal against features between compressor 10 and housing 30 to prevent unregulated refrigerant flow between the various regions. The refrigerant in the first end portion 38 is isolated from refrigerant in the second end portion 40 by a piston 50 configured to slide sealingly along a inner sealing region 43 arranged radially about the longitudinal axis 32. The inner sealing region 43 helps to prevent unregulated refrigerant flow between the various regions. The first end portion 38 has at least one opening 44 through the housing 30 for providing a path for refrigerant to flow between the external suction region 20 and the internal suction region 22.

Figure 3:
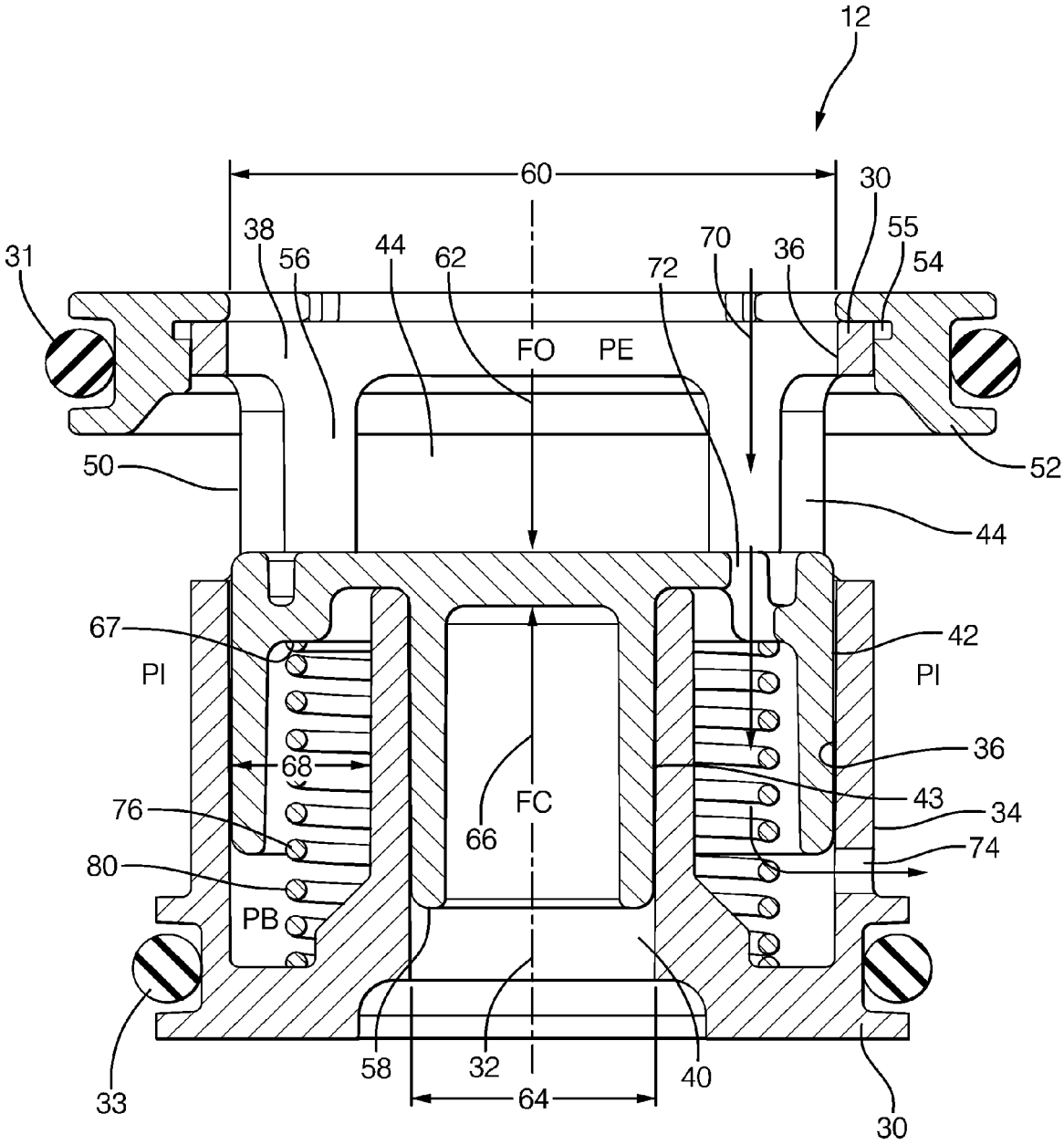
FIG. 3 is a cross sectional view of the SSV in FIG. 1.
Figure 4:
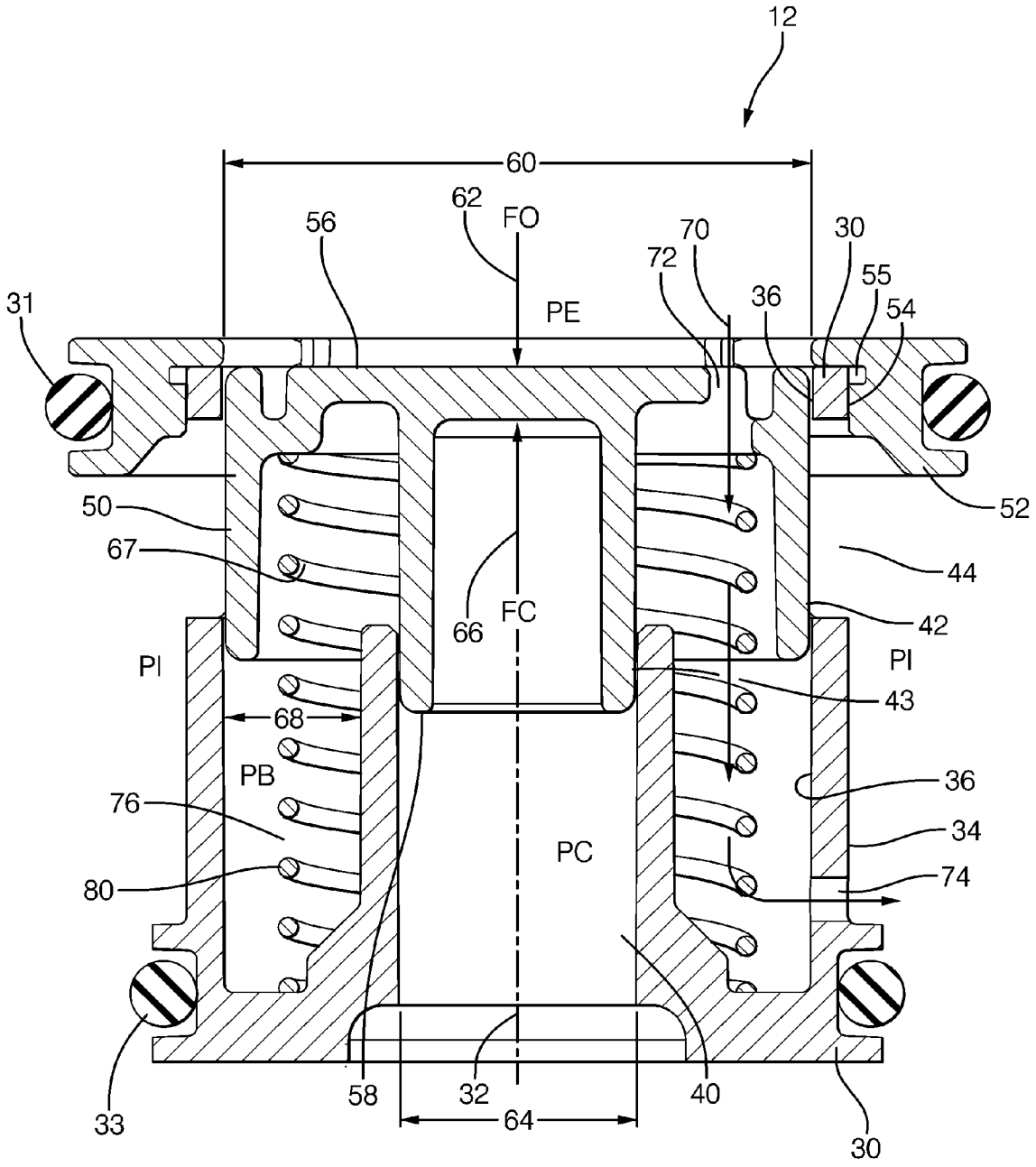
FIG. 4 is a cross sectional view of the SSV in FIG. 1.

The piston 50 is configured to engage features of the first end portion 38 for creating a variable obstruction to refrigerant flowing through the opening 44, and thereby establishing a restriction on fluid communication and noise communication between the external suction region 20 and the internal suction region 22. FIG. 2 shows the SSV 12 as partially open with the piston 50 in an intermediate position, thereby partially obstructing opening 44. FIG. 3 shows the SSV 12 as open with the piston 50 positioned to cause the least obstruction of the opening 44. FIG. 4 shows the SSV 12 as closed with the piston 50 positioned to cause the greatest obstruction of the opening 44. When the SSV is closed or nearly closed, the restriction on fluid communication between the internal suction region 22 and the external suction region 20 is sufficient to prevent noise generated by suction reed valve 18 from propagating to evaporator 15. If the opening 44 is unobstructed, then the noise generated by the suction reed valve 18 may propagate to the evaporator 15. The housing 30 and the piston 50 are configured so the piston 50 can move to create a variable obstruction of opening 44.

Referring to FIG. 2, the piston 50 is retained in the housing 30 by a retainer 52 fixedly coupled to the housing 30 at interface surface 54. The housing 30, the retainer 52, and the piston 50 are preferably made of a polymer suitable for exposure to refrigerant. Alternately, the parts may be made of a metal or ceramic. The housing 30 and the retainer 52 are preferable coupled at the interface surface 54 by a snap fit feature 55, because snap fitting parts together is considered to be an economical and reliable process. Alternately, the attachments could be made gluing, laser welding, ultrasonic welding, or friction welding.

Still referring to FIG. 2, the piston 50 has a first face 56 defining a first face area 60 at one end of the piston, a second face 58 axially opposed to the first face 56 and defining a second face area 64 smaller than the first face area 60, and a third face 67 having an annular shape concentric with and radially separated from the second face area 64 and defining a third face area 68. The arrangement of the piston 50 in the housing 30 defines a bleed cavity 76 containing refrigerant at a bleed pressure PB. An outer sealing region 42 and an inner sealing region 43 help to prevent unregulated refrigerant flow into and out of the bleed cavity 76. The first face 56 is acted upon by refrigerant at the external suction pressure PE, the second face 58 is acted upon by refrigerant at the crankcase pressure PC, and the third face is acted upon by refrigerant at the bleed pressure PB. Refrigerant at the external suction pressure PE acting over the first face area 60 generates an opening force 62 (FO). Refrigerant at the crankcase pressure PC acting over the second face area 64 and refrigerant at the bleed pressure PB acting over the third face area constructively combine with each other to supplement each other and generate a closing force 66 (FC) in opposition to the opening force 62. A balance of forces including the opening force 62 and the closing force 66 influences the position of piston 50 within housing 30 for determining the degree of obstruction of opening 44.

The configuration of the piston 50 and the housing 30 is such that the value of the first face area 60 is approximately equal to the value of the second face area 64 combined with the value of the third face area 68. An alternative configuration for the piston 50 may have the outer sealing region 42 moved radial outward or inward such that the combined values of the second face area and the third face area 68 could be greater or less than the first face area 60. Moving the outer seating region 42 inward would create a fourth area that undercut and opposed the first face area 60 that would be exposed to refrigerant at pressure PI. Having the option to vary the relationships between the various face areas is advantageous for tuning various performance characteristics of the SSV 12.

The first face 56 and second face 58 are rigidly coupled to each other. When compared to piston assemblies where the opposing faces are coupled together by a spring, having the faces 56 and 58 rigidly coupled is advantageous because the number of parts in the SSV 12 is reduced and the degree of obstruction of valve opening 44 is more directly influenced by PC.

FIG. 2 shows the SSV 12 in an intermediate position in which the position of piston 50 causes a partial obstruction of opening 44, thereby providing a moderate degree of restriction of refrigerant fluid communication between the external suction region 20 and the internal suction region 22. FIG. 3 shows the SSV 12 in a fully open position in which the position of piston 50 provides a minimum of obstruction of opening 44, thereby causing a low degree of restriction of refrigerant fluid communication between the external suction region 20 and the internal suction region 22. FIG. 4 shows the SSV 12 in a fully closed position in which the position of piston 50 causes maximum obstruction of opening 44, thereby causing a high degree of restriction of refrigerant fluid communication between the external suction region 20 and the internal suction region 22. In the exemplary embodiment there are four openings 44 with an opening area of about 50 square millimeters for a total opening area of about 200 square millimeters. The area of opening 44 may be varied to meet the minimum restriction and pressure loss requirements of various compressors.

In another embodiment, the piston 50 and housing 30 are configured to define a bleed cavity 76 containing refrigerant at a bleed pressure PB. The configuration creates an outer sealing region 42 and an inner sealing region 43 to prevent unregulated refrigerant flow into and out of bleed cavity 76. The piston has a third face 67 defining a third face area 68 that is exposed to refrigerant from the bleed cavity. Refrigerant at the bleed pressure PB acts upon the third face area to generate a force in a direction that is combined with the closing force. The force generated by bleed cavity helps to dampen piston 50 motion and keep the position of the piston 50 stable. The volume of bleed cavity 76 for a given piston position also effects piston position stability and may be adjusted by changing thickness of the wall sections forming the piston 50 and housing 30.

In another embodiment, the housing 30 includes a housing bleed orifice 74 providing fluid communication between the internal suction region and the bleed cavity. The fluid communication provided by the housing bleed orifice 74 helps to regulate the bleed pressure PB in bleed cavity to prevent excessive delay in the opening of the SSV 12 in the event that there is a sudden change in PE, PI, or PC. The optimum size of the housing bleed orifice 74 is dependent on the desired response characteristics of the SSV and is influenced by the volume of the bleed cavity 76. For the exemplary SSV 12 shown in FIG. 2-4, the size of the housing bleed orifice 74 is about 2 millimeters.

In another embodiment the piston 50 further comprises a piston bleed orifice 72 providing fluid communication between the external suction region and the bleed cavity 76. The optimum size of the piston bleed orifice 72 is also dependent on the desired response characteristics of the SSV 12. For the exemplary SSV 12 shown in FIG. 2-4, the size of the piston bleed orifice 72 is about 1.0 millimeters.

In another embodiment, the SSV has a refrigerant bleed path 70 between the external suction region 20 and the internal suction region 22. It is advantageous to have a bleed path to allow a minimum flow of refrigerant at all times. If the bleed path 70 is too restrictive then the compressor efficiency at low refrigerant flow rates is compromised. If the bleed path 70 is too unrestrictive, then suction reed pulsation noise may propagate to the evaporator at low refrigerant rates. In the instant embodiment the bleed path 70 includes a piston bleed orifice 72 and a housing bleed orifice 74. Exemplary diameters for the piston bleed orifice and the housing bleed orifice are about 1.0 and about 2.0 millimeters respectively. The ratio of the two orifices influences the opening pressure characteristics so the SSV opens at the correct suction pressure. The size of each orifice 72, 74 is optimized so the SSV responds quickly to changes in pressure while insuring valve stability. If the orifices are too small, then the SSV may respond slowly to changes in pressures PE, PI, and PC. If the orifices are too large, then the piston position may be unstable. For the exemplary SSV described herein, the bleed pressure PB is normally less than 1 pound per square inch (p.s.i.) above the internal suction pressure PI when the compressor is operating. Furthermore, the restriction of the SSV when the piston 50 is in the closed position may be reduced by adding a piston stop (not shown) that prevents the piston 50 from moving to a position that completely overlaps opening 44.

In another embodiment, the SSV has a spring 80 arranged to bias the piston 50 in the closing direction. It is advantageous for the SSV 12 to be closed when the air conditioner is off to insure that the valve is closed when the compressor is first activated. Furthermore, when the air conditioner is on and PC-PE differential is low, small perturbations in PC and PE can cause the piston 50 to generate audible noise. The spring rate of the spring 80 is selected as low as possible to minimize SSV restriction at high refrigerant flow rates, but large enough to overcome any piston to housing friction to assure that the SSV 12 is in the closed position when the air conditioner is not activated. For the SSV 12 shown in FIG. 2-4, an exemplary spring rate is 0.5 pounds per inch where the spring 80 is preloaded to about 0.1 pounds.

Figure 5:
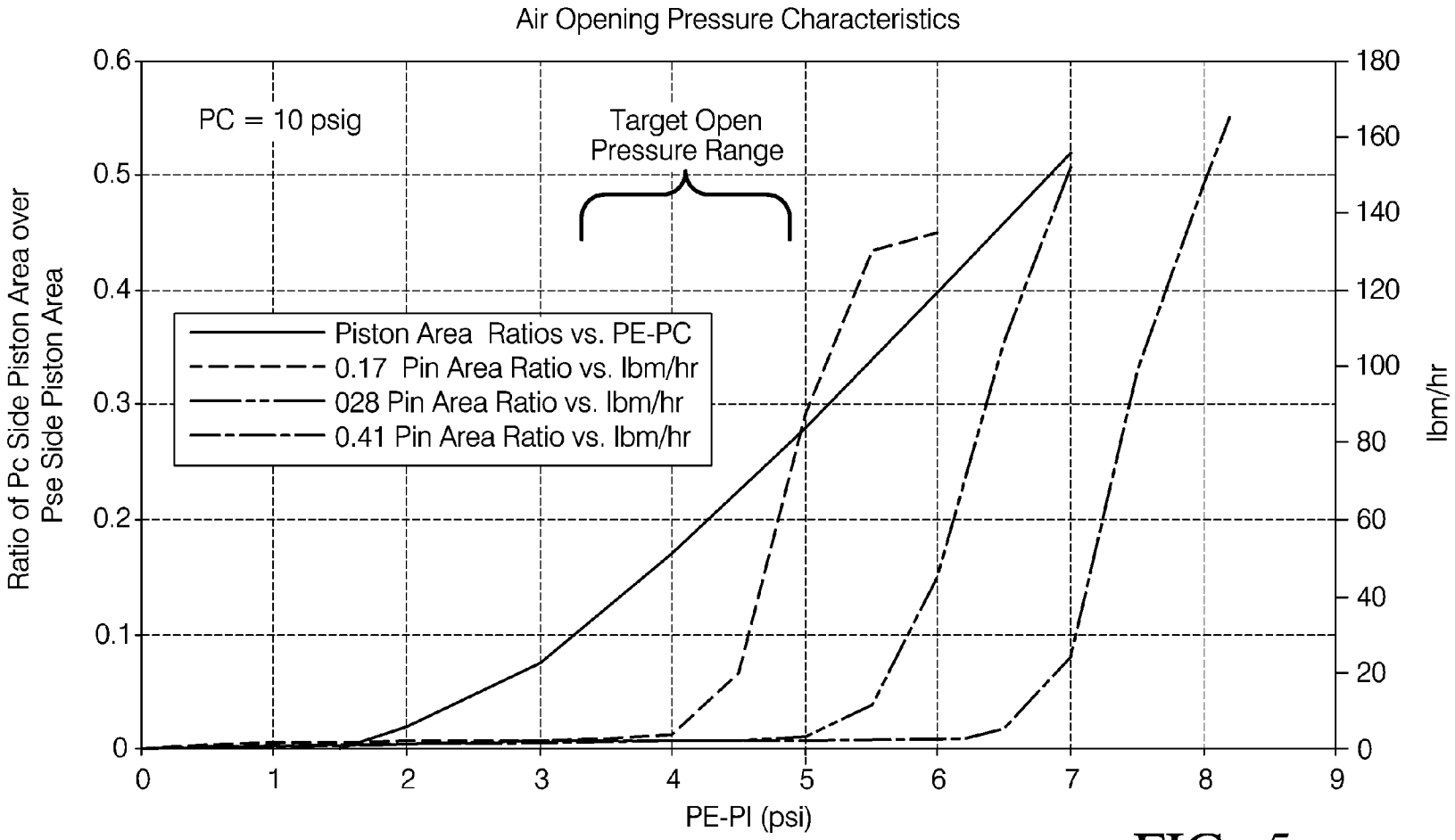
FIG. 5 is a graph showing characteristics of the SSV in FIGS. 2-4.

When the SSV 12 opens, the ability of the SSV to prevent noise propagation is reduced. The SSV 12 has an opening pressure characteristic that indicates the conditions when the SSV 12 will begin to open. A test was performed in which the region labeled PC was exposed to air at a fixed pressure of 10 p.s.i.g., the region labeled PI was exposed to air at atmospheric pressure, the air pressure of the region labeled PE was varied, and the mass flow of air from the region labeled PE to the region labeled PI was measured. Three SSV's were tested, with all three having a first face area of 254 square millimeters. Each of the three SSV's had a different second face area 64 of 44, 71, and 104 square millimeters so the ratios of the respective SSV's tested were 0.17, 0.28, and 0.41 respectively. FIG. 5 is a graph showing the results of the test in which the three curves correspond to three SSV's having different area ratios as labeled. The opening pressure characteristic is indicated by the PE-PI value where the slope of the curve changes from substantially parallel to the PE-PI axis. For example, for the SSV having an area ratio of 0.17, the opening pressure PE-PI is 4 p.s.i. As can be seen from the data, as the ratio is reduced, the opening pressure is reduced. The straight line on the graph is a projection of the piston area ratios versus PE-PC based on the three opening pressure data points of 4.0 p.s.i. for a ratio of 0.17, 5.0 p.s.i. for a ratio of 0.28, and 6.3 p.s.i. for a ratio of 0.41. From noise testing, a correlation between compressor level refrigerant flow and this test is known so that it is desirable for the SSV to have an opening pressure in the range of about 3.5 to about 4.8 p.s.i. The lower end of the target open pressure range is selected to ensure that the valve is restricting flow sufficiently to prevent suction reed valve noise from leaving the compressor. The upper end of the target is selected to minimize pressure losses with the valve fully opened. Based on this, projecting the preferred range onto the straight line gives a range of target ratios of about 0.13 to about 0.28. If a different compressor is selected for the air conditioner, then it is necessary to repeat the noise testing to determine the preferred range of area ratios for the different compressor.

Figure 6:
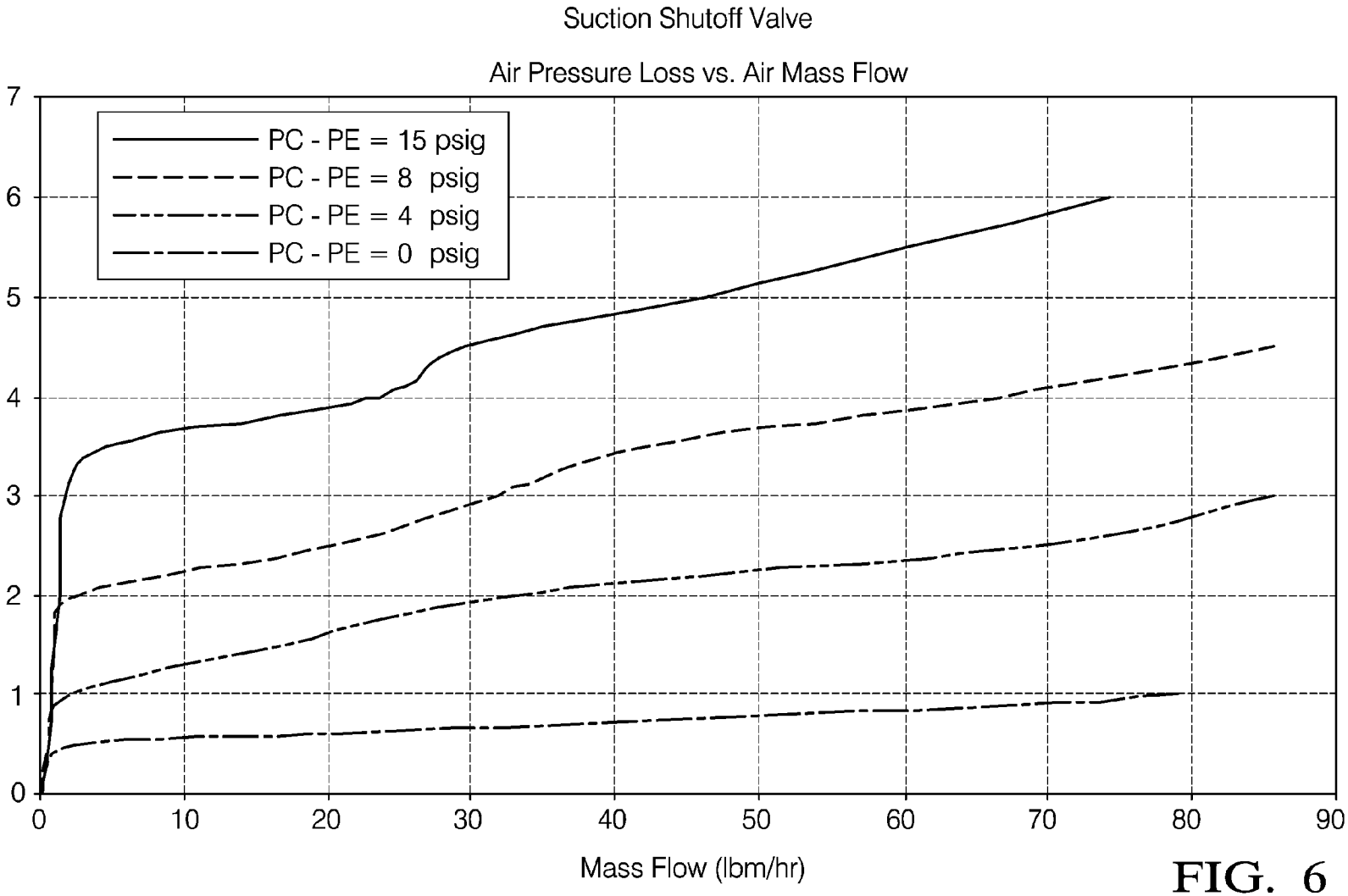
FIG. 6 is a graph showing characteristics of the SSV in FIGS. 2-4.

FIG. 6 shows performance characteristics of the SSV 12 having a piston area ratio of 0.17 in a test setup similar to that used for FIG. 5. In this test, the pressure difference PC-PE is fixed at the values listed (0, 4, 8, and 15 p.s.i.), PI is varied to induce air flow, and the mass flow of air from the region labeled PE to the region labeled PI is measured. Noise testing has shown that the exemplary SSV is effective to prevent noise generated by the suction shutoff valve 18 from propagating to the evaporator 15. When compared to SSV's having area ratios greater than the exemplary value, particularly SSV's having area ratios of 1.0, the External-to-Internal Suction Pressure Loss values of the SSV's with greater area ratios exhibit higher External-to-Internal Suction Pressure Loss values and thus would reduce the efficiency of the compressor at high refrigerant flow rates.

Thus, a variable displacement compressor having a suction shutoff valve (SSV) effective to prevent noise from propagating to the evaporator and having reduced restriction to refrigerant flow at high refrigerant flow rates is provided. The SSV has an opening force generated by the suction pressure acting upon the first face area that urges the SSV to decrease the restriction opposing a closing force generated by the crankcase pressure acting upon the second face area that urges the SSV to increase the restriction, wherein the second face area is smaller than the first face area, thus reducing the closing force relative to the opening force for reducing the restriction of the SSV at high refrigerant flow rates and thereby increasing the efficiency of the compressor 10 at high refrigerant flow rates While this invention has been described in terms of the preferred embodiments thereof, it is not intended to be so limited, but rather only to the extent set forth in the claims that follow.

We claim:

1. A variable displacement compressor for compressing refrigerant drawn from a suction region in fluid communication with an evaporator, and discharging refrigerant into a discharge region at a discharge flow rate, wherein varying the displacement influences the discharge flow rate and is effected by regulating fluid communication of refrigerant in a crankcase region with the discharge region, and in which a suction reed valve for preventing refrigerant drawn into the compressor from returning to the suction region is capable of generating a noise when the discharge flow rate is low, said compressor comprising:

a suction shutoff valve (SSV) segregating the suction region into an external suction region and an internal suction region, said SSV comprising a housing defining a longitudinal axis, said housing comprising an outer surface exposed to refrigerant from the internal suction region at an internal suction pressure, and an inner surface, said inner surface having a first end portion exposed to refrigerant from the external suction region at an external suction pressure, and a second end portion exposed to refrigerant from the crankcase region at a crankcase pressure, said SSV further comprising a piston arranged within the housing for isolating the first end portion from the second end portion by sliding sealingly against the inner surface along the longitudinal axis, said first end portion including an opening through the housing for fluid communication of refrigerant between the external suction region and the internal suction region, said piston configured to engage the housing first end portion and cover the opening for establishing a restriction on the fluid communication between the external suction region and the internal suction region sufficient to impede the noise generated by the suction reed valve from propagating to the evaporator when the discharge flow rate is low, said piston comprising a first face exposed to refrigerant from the external suction region and defining a first face area, and a second face rigidly coupled to and axially opposed to the first face, exposed to refrigerant from the crankcase region, and defining a second face area, whereby an opening force generated by the external suction pressure acting upon the first face area that urges the SSV to decrease the restriction is opposed by a closing force generated by the crankcase pressure acting upon the second face area that urges the SSV to increase the restriction, wherein the second face area is smaller than the first face area for reducing the closing force relative to the opening force, thereby reducing the restriction of the SSV at high refrigerant flow rates.

2. The compressor in accordance with claim 1, wherein the piston and housing are configured to define a bleed cavity containing refrigerant at a bleed pressure, wherein the piston further comprises a third face defining a third face area exposed to refrigerant from the bleed cavity, whereby the bleed pressure acting upon the third face area is directed to supplement the closing force.

3. The compressor in accordance with claim 2, wherein the housing further comprises a housing bleed orifice providing fluid communication between the internal suction region and the bleed cavity.

4. The compressor in accordance with claim 3, wherein the piston further comprises a piston bleed orifice providing fluid communication between the external suction region and the bleed cavity.

5. The variable displacement compressor in accordance with claim 1, wherein the suction shutoff valve further comprises a bleed path between external suction region and the internal suction region to limit the restriction of the SSV to a restriction maximum.

6. The compressor in accordance with claim 5, wherein the bleed path is provided by a piston bleed orifice through the first face of the piston and a housing bleed orifice through the housing.

7. The compressor in accordance with claim 1, wherein the suction shutoff valve further comprises a spring arranged to bias the piston in the closing direction.

* * * * *